United States Patent [19]

Doss

[11] Patent Number: 4,986,267

[45] Date of Patent: Jan. 22, 1991

[54] UNDERWATER BREATHING APPARATUS

[76] Inventor: Stephen F. Doss, 6508 Mockingbird Way, St. Petersburg, Fla. 33707

[21] Appl. No.: 217,666

[22] Filed: Jul. 12, 1988

[51] Int. Cl.[5] ..... A62B 7/02

[52] U.S. Cl. ..... 128/201.27; 128/201.28; 128/204.18; 441/136

[58] Field of Search ..... 128/201.27, 201.21, 128/202.14, 201.11, 201.28, 202.29, 204.18; 441/136, 124, 43, 45, 80, 67

[56] References Cited

U.S. PATENT DOCUMENTS

| | | | |
|---|---|---|---|
| 183,521 | 10/1876 | Weck | 128/201.27 |
| 813,431 | 2/1906 | Iwanami et al. | 128/201.27 |
| 2,241,314 | 5/1941 | Mohler | 441/136 |
| 3,064,646 | 11/1962 | Miller | 128/201.11 |
| 3,370,586 | 2/1968 | Aragona et al. | 128/201.11 |
| 3,467,091 | 9/1969 | Aragona | 128/201.11 |
| 4,362,154 | 12/1982 | Le Masson | 128/201.28 |
| 4,521,200 | 6/1985 | Fatello | 441/67 |
| 4,674,493 | 6/1987 | Mitchell | 128/201.27 |

FOREIGN PATENT DOCUMENTS

| | | | |
|---|---|---|---|
| 1139978 | 7/1957 | France | 128/201.11 |
| 1473382 | 3/1967 | France | 128/201.11 |
| 2593136 | 7/1987 | France | 128/201.27 |

*Primary Examiner*—William Pieprz
*Assistant Examiner*—Kimberly L. Asher
*Attorney, Agent, or Firm*—Leon Gilden

[57] ABSTRACT

An improved underwater breathing apparatus includes a net bag suspended from an interior portion of a donut-shaped float with a compressed air diving tank being supported within the bag. One or more breathing hoses may be attached to the tank, and each hose may be of a fifty foot length or more. Conventional second stage regulators are attached to the free ends of the hoses so that divers may perform shallow water dives without the necessity of carrying compressed air cylinders on their backs.

1 Claim, 4 Drawing Sheets

UNDERWATER BREATHING APPARATUS

BACKGROUND OF THE INVENTION

1Field of the Invention

The present invention relates to underwater breathing devices, and more particularly pertains to a new and improved compressed air breathing delivery system designed to allow a diver an extended degree of unencumbered shallow water diving.

2. Description of the Prior Art

There are many different types of apparatuses and methods which facilitate underwater breathing by a swimmer. Of those types of devices designed to deliver compressed or pumped air for breathing purposes, the self contained underwater breathing apparatus (scuba) which employs a compressed air cylinder attachable to a diver's body is the most widely known and used. In this regard, one or more compressed air tanks may be directly attached to a diver's back, and a so-called first stage regulator typically reduces a three thousand pounds per squared inch pressurized air supply to one hundred and forty pounds per square inch for delivery to a breathing tube. The free end of the breating tube has a second stage regulator mounted thereto and the second stage regulator includes a mouth piece to permit are delivery to the diver. By the same token, the second stage regulator operates to reduce the one hundred and forty pounds per square inch air supply to a breathable ambient air pressure.

While being functional for their intended purpose, conventional scuba air supply tanks are by necessity quite heavy and awkward to carry. A fully equipped diver wearing a wet suit and weight belt along with a single scuba tank may find himself carrying over one hundred pounds of equipment. Needless to say, this amount of gear is necessary for deep water dives; however, there has been an ongoing intense effort to reduce the amount of diver-carried weight—especially where shallow water dives of thirty feet or less are to be undertaken.

In response to this interest in reducing diver-carried weight in shallow water diving situations, a number of floating devices which supply pressurized air from the surface through a breathing tube down to a diver have been developed. In this regard, reference is made to U.S. Pat. No. 4,674,493 which issued to D. Mitchell on June 23, 1987. The Mitchell underwater breathing apparatus discloses a sealed, water-proofed container which is designed to float on the surface of the water and which has an inlet above the water and an outlet below. The outlet is adapted to be coupled to a hose which will provide air to a submerged swimmer, and the inside of a container houses a pump which couples the inlet to the outlet and forces pressurized air through the breathing hose. The pump is driver by an electric motor retained with a container. The Mitchell device is actually an improvement over floating snorkel assemblies such as those shown in U.S. Pat. No. 3,467,091, which issued to R. Aragona of Sept. 16, 1969, and U.S. Pat. No. 4.269.,182, which issued to B. Le on May 26, 1981. Both of these patents disclose snorkel tubes attacahed to surface floats with the snorkels being attached to long breathing tubes carried by the diver. As is well known however, snorkels have a very limited diving depth allowance, i.e., is virtually impossible for a diver to draw air through a snorkel at a depth greater than ten to fifteen feet.

While the Mitchell device may operate as disclosed, it apparently has met with little or no commerical success, as have its gasoline engine powered counterparts—most likely due to the complexity of design and expense of manufacture. Accordingly, it would appear that there is a continuing need for devices which reduce the amount of diver-carried weight during shallow water diving excursions, and in this regard, the present invention substantially fulfills this need.

SUMMARY OF THE INVENTION

In view of the foregoing disadvantages inherent in the known type of underwater breathing apparatuses now present in the prior art, the present invention provides an improved underwater breathing apparatus wherein the use of a compressed air cylinder can be employed to provide a breathing air supply to a diver without the necessity of the diver carrying the cylinder atached to his body. As such, the generaly purpose of the present invention, which will be described subsequently in greater detail, is to provide a new and improved underwater breathing apparatus which has all the advantages of the prior art underwater breathing apparatuses and none of the disadvantages.

To attain this, the present invention employs the use of a donut-shaped float, such as a small inner tube or the like, with an elogated net bag being attached thereto and suspended through the center of the float. A conventional compressed air cylinder of the type typically employed for scuba diving may be supported within the net bag so as to be retained on the surface of the water at all times. The net bag and float assembly could be similar to the arrangement shown in U.S. Pat. No. 2,241,314 which issued to P. Mohler on May 6, 1941.

A conventional first stage regulator attached to the top of the float-supported scuba tank would typically have two fifty foot lengths of high visibility breathing hose attached thereto, and conventional second stage regulators are attachable to the free ends of the hoses. A tank securing strap is attachable between the first stage regulator and the float rim, and hose securing straps are connected between the float rim and the individual breathing hoses. The invention further includes the use of clip rings which are attachable to a diver's bathing suit and which include a small tether to which an individual breathing hose may be attached. This allows the strain of dragging a breathing hose under water to be borne by the diver's clothing so as to not cause discomfort around the diver's mouthpiece area. Another optional feature includes a tank stability strap designed to retain the tank within the support net as well as to effect a stabilizing attachment of the breathing hoses to the entire assembly.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangments of the components set forth in the following description or illustrated in the drawings. The invention is capable of other embodiments and of being practiced and carried out it various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determined quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved underwater breathing apparatus which has all the advantages of the prior art underwater breathing apparatuses and none of disadvantages.

It is another object of the present invention to provide a new and improved underwater breathing apparatus which may be easily and efficiently manufactured and marketed.

It is a further object of the present invention to provide a new and improved underwater breathing apparatus which is of a durable and reliable construction.

An even further object of the present invention is to provide a new and improved underwater breathing apparatus which is susceptible of a low cost of manufacture with regard to both materials and labor, and which accordingly is then susceptible of low prices of sale to the consuming public, thereby making such underwater breathing apparatuses economically available to the buying public.

Still yet another object of the present invention is to provide a new and improved underwater breathing apparatus which provides in the apparatuses and methods of the prior art some of the advantages thereof, while simultaneously overcoming some of the disadvantages normally associated therewith.

Still another object of the present invention is to provide a new and improved underwater breathing apparatus which provides for an inexpensive means of reducing diver-carried weight during shallow water dives.

Yet another object of the present invention is to provide a new and improved underwater breathing apparatus which provides for diver weight reduction in a simple and efficient manner.

These together with other objects of the invention, along with the various features of novelty which characterize the invention, are pointed out with particularity in the claims annexed to and forming a part of this disclosure. For a better understanding of the invention, its operation advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
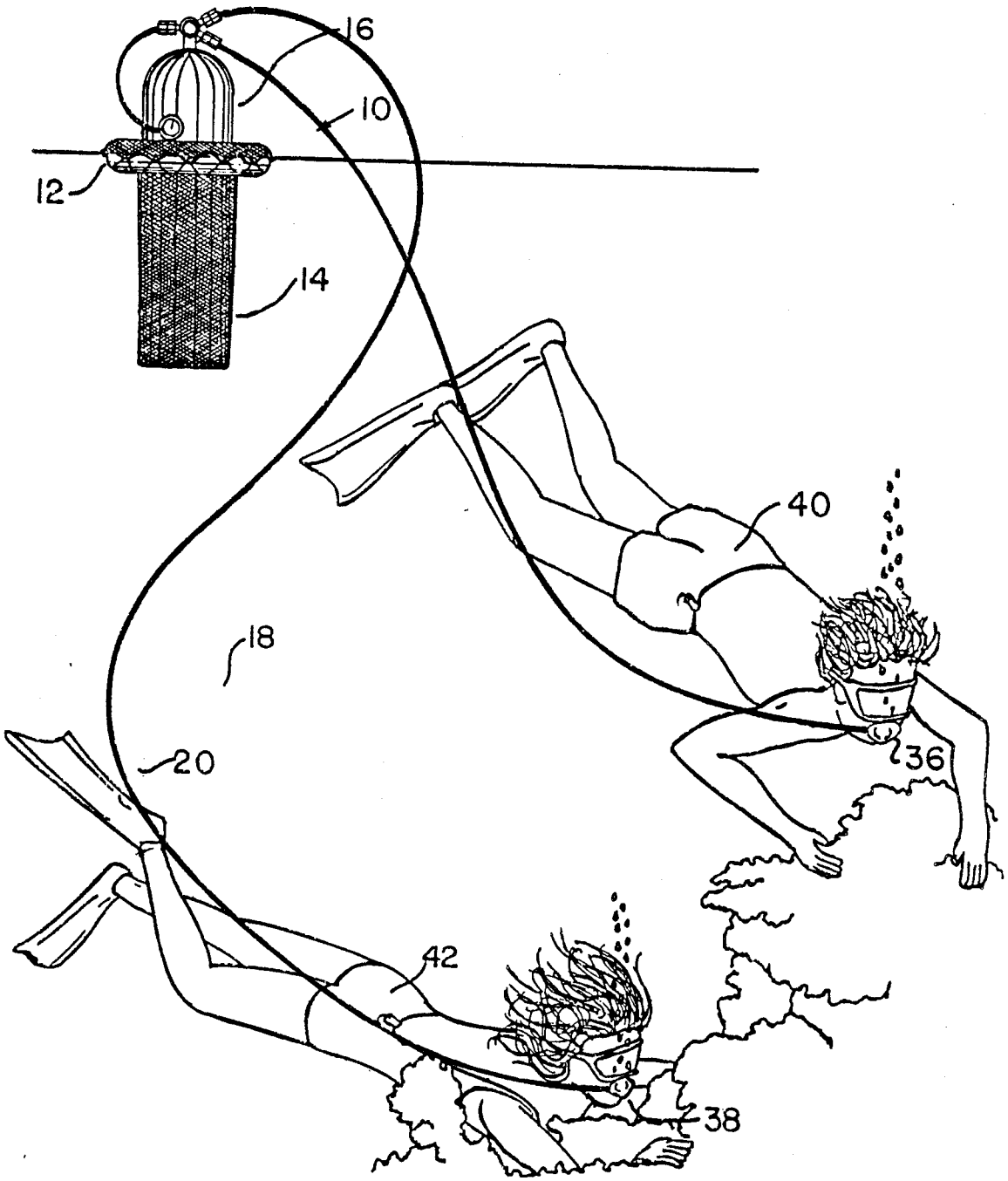
FIG. 1 is an illustration of the present invention showing the same being utilized by two divers.

With reference now to the drawings, and in particular to FIG. 1 thereof, a new and improved underwater breathing apparatus embodying the principles and concepts of the present invention and generally designated by the reference numeral 10 will be described.

More specifically, it will be noted that the underwater breathing apparatus 10 essentially comprises a donut-shaped float member 12, a net bag 14 secured to and retained within a center portion of the float, and a compressed air tank 16 to which a pair of extended length breathing hoses 18, 20 are attached.

Figure 4:
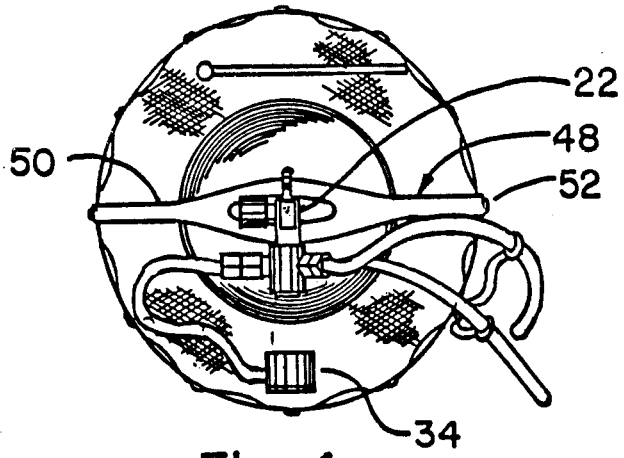
FIG. 4 is a top plan view of the invention.
Figure 2:
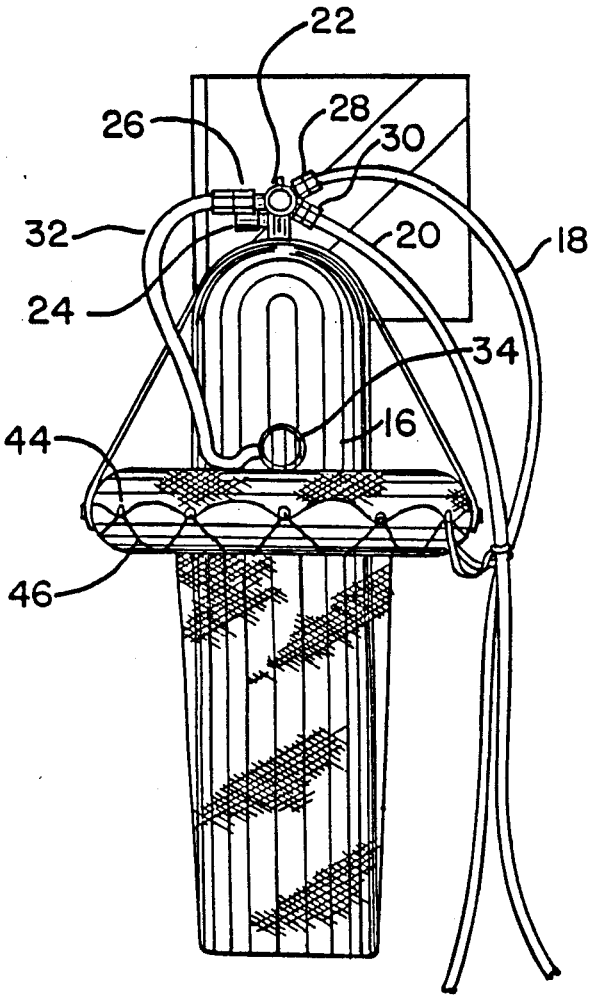
FIG. 2 is a front elevation view of the invention.
Figure 3:
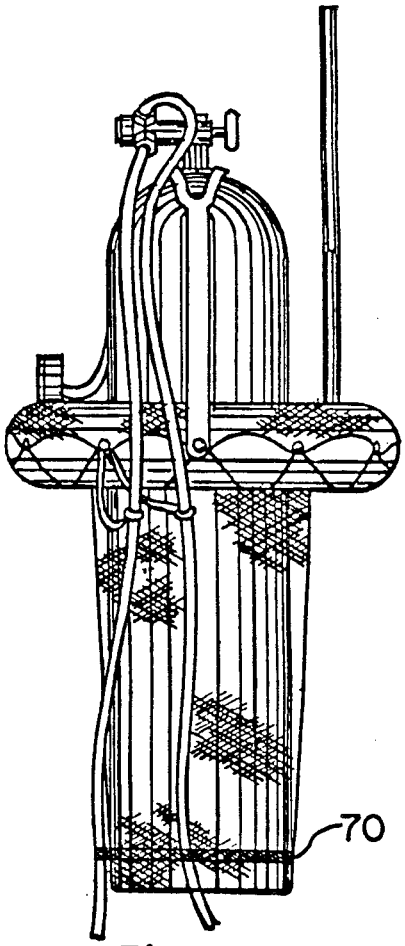
FIG. 3 is a side elevation view of the invention.

Referencing FIGS. 2, 3 and 4 in conjunction with FIG. 1, it will be noted that a first stage air pressure regulator 22 is operably attached to a topmost portion of the air tank 16. The air pressure within the tank 16 will typically reach three thousand pounds per square inch when the tank is fully charged, and the first stage regulator 22 operates to reduce this air pressure to approximately one hundred and forty pounds per square inch. The first stage regulator 22 is in direct fluid communication with the pressurized air within the tank 16 and includes a shut off valve 24, as well as three air outlet fittings 26, 28, 30. A short length of flexible hose 32 is attached to the fitting 26, and an air pressure gauge 34 is connected to the remaining free end of the hose. The air pressure gauge 34 allows a user to determine the amount of remaining pressurized air within the tank 16.

The aforementioned breathing hoses 18, 20, each of which could typically be of a fifty foot length or more, are respectively attached to the air outlets 28, 30. Conventional second stage regulators 36, 38 are attached to the remaining free ends of the hoses 18, 20, and these second stage regulators are provided with mouth pieces to facilitate the delivery of breathing air to underwater swimmers 40, 42. The second stage regulators 36, 38 reduce the one hundred and forty pound per square inch air pressure from the first stage regulator 22 down to an ambient air pressure which is convenient and safe for diver usage.

With further reference to FIGS. 1–4, the manner of atachment of the tank supporting net 14 to the float 12 will be discussed. In this regard, the donut-shaped float 12 could be formed of a solid floatable material, such as styrofoam or the like, or alternatively, it could be formed from an air inflatable flexible material such as rubber, plastic etc. The net 14 in its preferred embodiment would be formed of a nylon mesh material and would be provided with a plurality of grommets 44 along a peripheral edge thereof through which an attachment line 46 could be laced to effect the desired attachment of the net to the float.

A compressed air tank retaining strap 48 is formed from two interconnectible strap sections 50, 52. As best illustrated in FIGS. 2, 3 and 4, the strap 50 would have a single end attached to the line 46 on one side of the float member 12, while the other strap 52 would similarly have a single end attached to an opposed side of the float by the line 46. The remaining free ends of the straps 50, 52 would be of a bifurcated design so as to be positionable on opposite sides of the first stage regulator 22, and in the preferred embodiment, the bifurcated ends of the two straps would be connected together by hook and loop fastening means, such as velcro or the like. As such, the tank restraining strap 48 would operate as a means to quickly secure a tank 16 within the net 14. By the same token, in the event that the net 14 and its attached float 12 should turn sideways or even upside down within the water, the tank 16 would still be retained within the assembly. Additionally, the retaining strap 48 would operate as a lifting handle to facilitate the lifting of the entire invention 10 out of the water into a boat, onto a dock, or to some other location.

Figure 5:
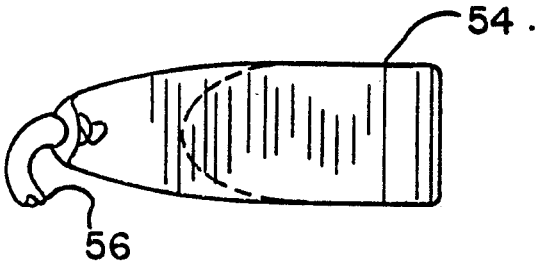
FIG. 5 is a front elevation view of the clothing clip forming a part of the present invention.
Figure 6:
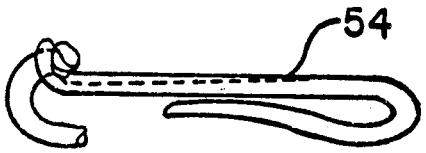
FIG. 6 is a side elevation view of the clothing clip.
Figure 7:
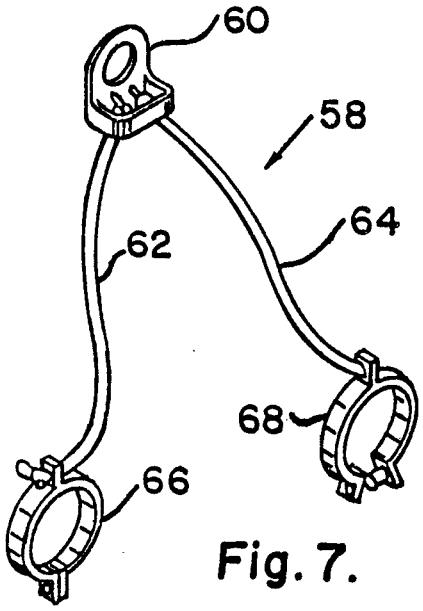
FIG. 7 is a perspective view of the hose tether assembly forming a part of the present invention.

With particular reference to FIG. 1, it can be observed that when divers 40, 42 are utilizing the invention 10, it is desirable that the divers have their hands free at all times. To accomplish this, means are provided for holding the breathing hoses 18, 20 in an attached manner to the bodies of the divers 40, 42 while also preventing undue stress fronm being exerted by the second stage regulators 36, 38 to the divers' mouth. In this connection, reference is made to FIGS. 5 and 6 of the drawings in conjunction with FIG. 1 wherein tethered clips 54 are illustrated. More specifically, each clip 54 is attached to one of the hoses 18, 20 by a tether 56, and such clips are designed to be frictionally engaged to the divers' clothing. As such, the clips 54 operate to hold the hoses 18, 20 in an attached manner of the bodies of the divers 40, 42 without undue stress or inconvenience. While the clips 54 as illustrated are functional for their intended purpose, it should be noted that the present invention envisions any type of clips which could operate to attach the hoses 18, 20 to the divers 40, 42. For example, such clips could include spring-biased alligator clips, pin fasteners, waist encircling bands, etc., and all such attachment means are within the intent and purview of the present invention as defined by the claims appended hereto.

Figure 8:
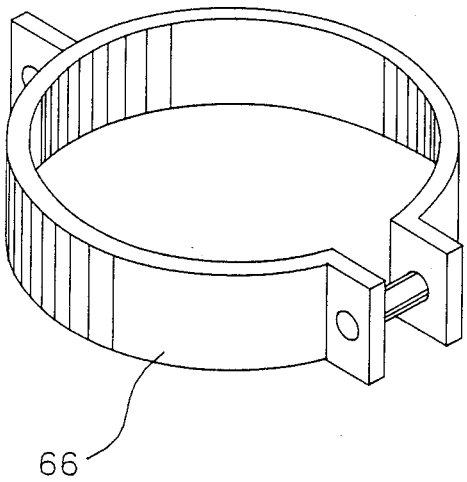
FIG. 8 is a perspective view of a hose holding ring forming a part of the present invention.
Figure 10:
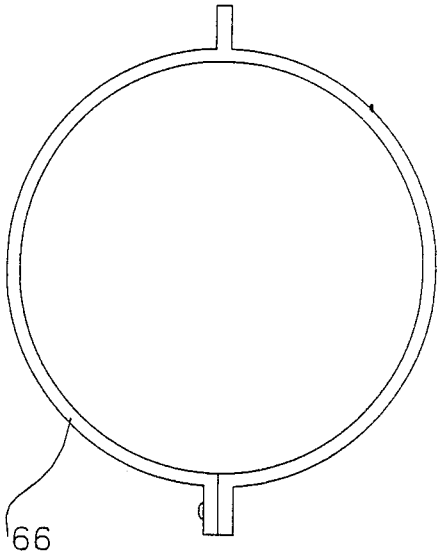
FIG. 10 is a top plan view of the ring.
Figure 9:
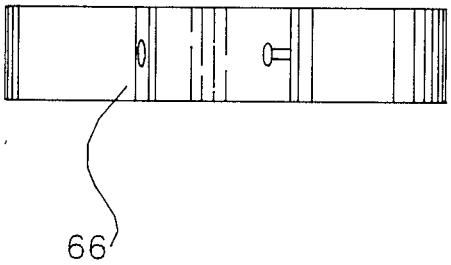
FIG. 9 is a side elevation view of a hose holding ring.
Figure 11:
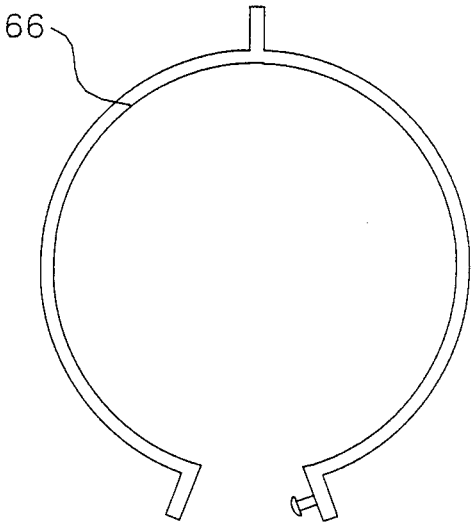
FIG. 11 is a top plan view of the ring showing the same in an open position.

It has also been found desirable to attach the hoses 18, 20 in a tethered manner to the float assembly 12 thereby to provide a greater degree of stability to the entire assembly. As illustrated in FIGS. 2 and 7–11, this is accomplished through the use of a further tether assembly which is generally designated by the reference numeral 58. The tether assembly 58 includes a ring member 60 operably attachable to the float 12 by means of the connecting line 46, and this ring member 60 has a pair of flexible tethers 62, 64 connected thereto. A pair of snap rings 66, 68 are conventionally attached to the free ends of the respective tethers 62, 64. The rings 66, 68 are typically of a flexible plastic construction and are designed to be fitted around the respective hoses 18, 20. In this regard, the rings 66, 68 may be positioned around the hoses 18, 20 when the rings are in an open position, such as shown in FIGS. 8, 9 and 11, and a molded snap fitting may be frictionally engaged to effect an attachment of the rings to a respective hose in the manner best illustrated in FIG. 10.

Another optional feature of the present invention includes an elastic stability band 70 such as shown only in FIG. 3 of the drawings. The band 70 is designed to be elastically fitted around the bottom of the net 14 so as to perform an additional tank 16 holding function. Additionally, the stability strap 70 operates to stabilize the invention 10 when the breathing hoses 18, 20 are positioned between the tank 16 and the strap. In this regard, as the divers 40, 42 swim underwater, the hoses 18, 20 tend to pull the invention along the surface. If such pulling force was strictly directed by the hoses 18, 20 to the first stage regulator 22, the tendency would be for the float member 12 to tip over which could result in a tank release from the support net 14. However, through a use of the stability strap 70, the diver supplied pulling force is directed to the bottom area of the tank 16 which lessens the likelihood of a capsize.

As to the manner of usage and operation of the present invention, the same should be apparent from the above description. Accordingly, no further discussion relating to the manner of usage and operation will be provided. In effect, the present invention 10 is designed primarily for shallow water diving. As long as shallow water diving is the purpose, there is no need for diver viewable pressure gauges although they could be supplied if deeper water diving were to be undertaken. Where such gauges are not provided, a diver can sense when the air supply is being depleted by the experienced difficulty in obtaining a full breath of air. The present invention 10 is particularly useful where divers are seeking lobsters, shells or the like around shallow reefs and in similar areas.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be restored to, falling within the scope of the invention.

What is claimed as being new and desired to be protected by Letter Patent of the United States is as follows:

1. A new and improved underwater breathing apparatus comprising:

at least one compressed air supply cylinder;

compressed air supply support means, said support means including a bag into which said compressed air supply cylinder is positioned, said bag being of a mesh net construction;

float means for supporting said compressed air supply support means, said float means including a donut-shaped float, said support means being affixed to said float and being retained within a central opening portion thereof;

bag attachment means, said bag attachment means including a flexible line laced around said float and being attached to said bag;

cylinder restraining means connected to said float to positively restrain said cylinder in said bag with said float;

air delivery means for delivering air from said compressed air supply cylinder to a swimmer utilizing said breathing apparatus, said air delivery means including at least one extended length of hose designed to deliver air from said compressed air supply cylinder to a swimmer, said air delivery means further including a first stage regulator mounted to said compressed air supply cylinder, said at least one extended length of hose being attached to said first stage regulator, said air delivery means further including a second stage regulator attached to a remaining free end of said at least one extended length of hose;

first tether means for connecting said at least one extended length of hose to said float;

second tether means for connecting said at least one extended length of hose to a swimmer; and cylinder stabilizing means operable to retain said compressed air supply cylinder in a vertical position while being towed by a swimmer, said cylinder stabilizing means including a strap positionable around the mesh net log and the bottom portion of said compressed air supply cylinder and being operable to connect said at least one extended length of hose thereto.

* * * * *